United States Patent [19]

Häring et al.

[11] 3,999,724

[45] Dec. 28, 1976

[54] YARN TENSIONING DEVICE

[75] Inventors: Theodor Häring, Dettinghofen; Hans Theihsen, Wuppertal-Barmen; Hans Günther Butterman, Krefeld, all of Germany

[73] Assignee: Hacoba-Textilmaschinen GmbH & Co. KG, Wuppertal-Barmen, Germany

[22] Filed: Dec. 18, 1974

[21] Appl. No.: 533,861

[52] U.S. Cl. ..... 242/151; 242/155 R

[51] Int. Cl.[2] ..... B65H 59/16; B65H 59/22

[58] Field of Search ..... 242/151, 152, 155 R, 242/131, 131.1, 147 R, 149

[56] References Cited

UNITED STATES PATENTS

| | | | |
|---|---|---|---|
| 17,835 | 7/1857 | Hoagland | 242/151 |
| 369,710 | 9/1887 | Hill | 242/151 |
| 765,104 | 7/1904 | Scott et al. | 242/151 |
| 2,655,325 | 10/1953 | Kuettler, Jr. et al. | 242/151 |
| 2,667,313 | 1/1954 | Klein | 242/155 R |
| 2,686,018 | 8/1954 | Courtney | 242/151 |
| 2,932,077 | 4/1960 | Honig | 242/155 R X |

FOREIGN PATENTS OR APPLICATIONS

| | | | |
|---|---|---|---|
| 883,107 | 7/1953 | Germany | 242/151 |

*Primary Examiner*—Stanley N. Gilreath
*Attorney, Agent, or Firm*—Neuman, Williams, Anderson & Olson

[57] ABSTRACT

In a yarn tensioning device, two abutting rolls in rotatable engagement at their peripheries have a yarn passed therebetween or around one of the rolls. A resilient covering of at least one of said rolls deforms because of such resilient covering peripherally engaging the other roll. The rolls are rotatably driven by pulling the yarn between the rolls, or around one of the rolls which may be mounted on ball bearings or the like. The inter-roll pressure effected at the peripheral areas of mutual engagement may be regulated by having one roll movable transversely to its axis of rotation and thus, the tension imparted to the yarn pulled between the rolls or over one of the rolls may be regulated accordingly.

4 Claims, 8 Drawing Figures

Fig. 1
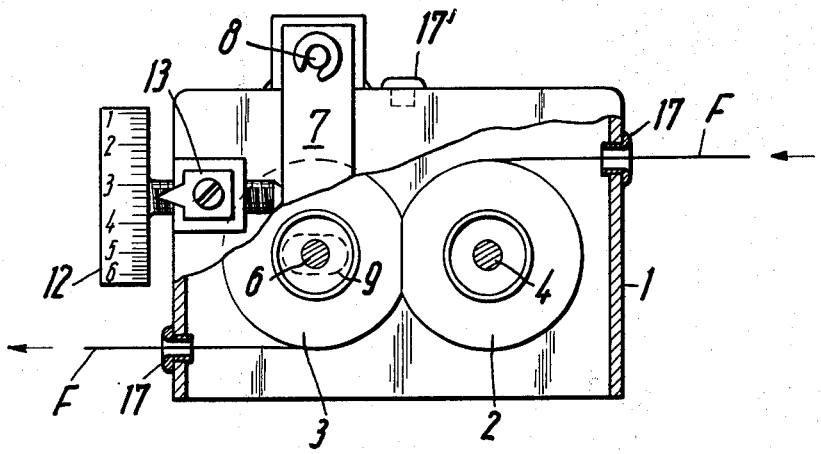
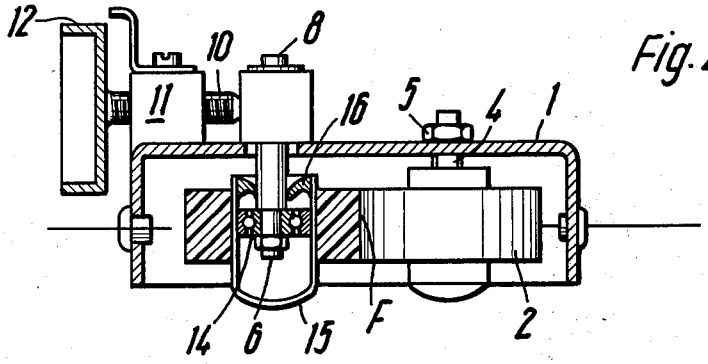
Fig. 2
Fig. 3
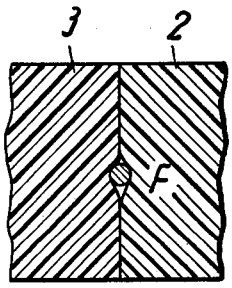
Fig. 4
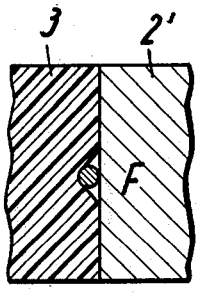

Fig. 6
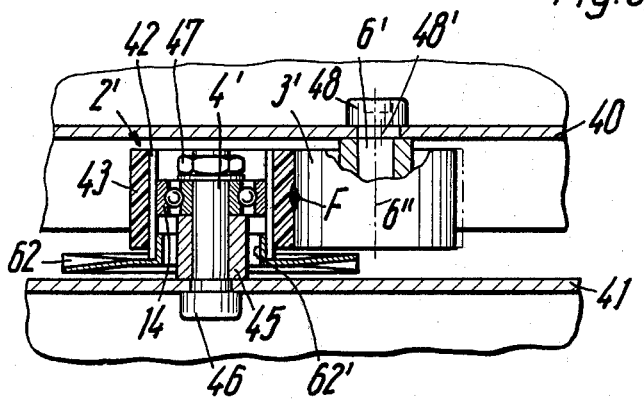
Fig. 7
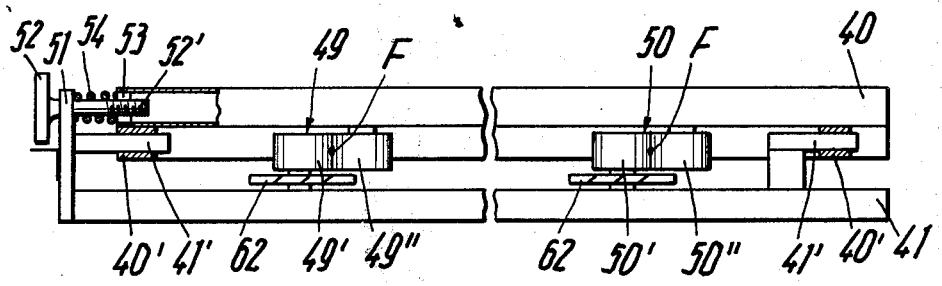
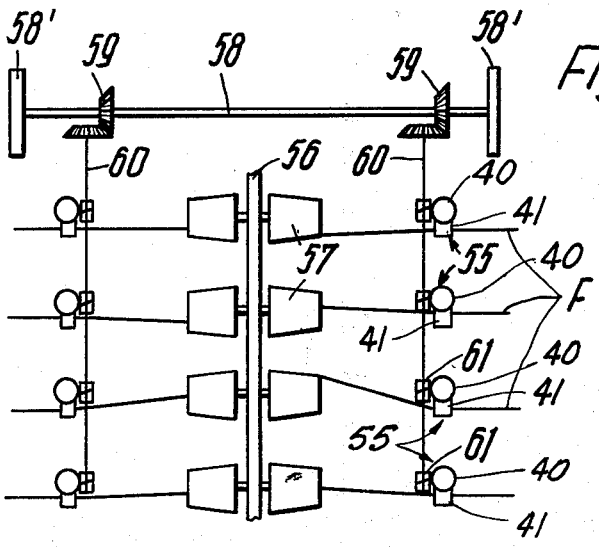
Fig. 8

YARN TENSIONING DEVICE

The invention refers to a yarn tensioning device such as is used in weaving and spinning mills. Yarn tensioning devices are well-known which tension the yarn by means of friction. In such devices the yarn is guided between two discs, loaded by means of springs or weights. This results in a use of the discs as well as the yarn. In the case of thick yarns employed with such tensioning devices, a sufficiently high tension cannot be obtained.

The invention hereinafter described is adapted to remedy this defect by utilization of a tensioning device which consists of two rolls rotatably supported in a housing or in a frame and lying one upon the other with adjustable preliminary tension at the circumferences. One of those rolls is covered with a rubber elastic material and the yarn to be tensioned is guided between the rolls so that it drives both rolls when passing through the device.

The tension on the yarn passing through such a tensioning device is obtained because of the pressure of the rolls on each other exerted at their abutting circumferences and resulting as the rubber elastic cover for one roll is deformed. Therefore, fulling has to be effected during the turning of the rolls and that corresponds to a braking of the rolls. If the pressure exerted between the rolls is increased, the tension effect on the processed yarn is increased correspondingly.

With such a tensioning device it is therefore possible to tension the yarn without using the yarn.

In the attached drawing, embodiments of tension devices made in accordance with this invention are illustrated in which:

FIG. 1 is the top plan view of a yarn tensioning device made in accordance with this invention partly broken away.

FIG. 2 is a sectional view of the device of FIG. 1, illustrating some of the elements thereof in elevation.

FIG. 3 is an enlarged sectional view of a tensioning device employing two rolls having an elastic periphery engaging a yarn passing therebetween.

FIG. 4 is a view similar to FIG. 3 in which only one roll has an elastic periphery.

FIG. 6 is a view corresponding to FIG. 2 of another embodiment of this invention.

FIG. 7 is a side elevational view partly in section of a yarn tensioning device with two or more pairs of rolls and with one common regulation device for both, and FIG. 8 is a schematic representation of a yarn tensioning system with a plurality of tensioning positions and one common regulation device for a plurality of bobbins mounted on a creel.

Figure 5:
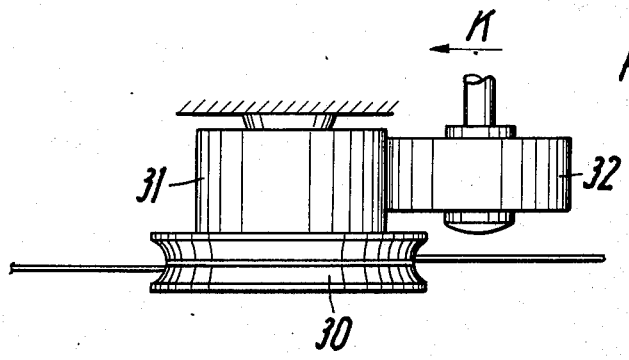
FIG. 5 is a side elevational view of the major components of a tensioning device; modification made in accordance with this invention.

All the illustrated embodiments of this invention incorporate the principle of tensioning yarn by means of two rolls rotatably engaging each other. The braking effect is adjustable by modification of the pressure of the rolls on each other.

FIGS. 1 and 2 illustrate a yarn tensioning device with a housing 1, open at the bottom, on which roll 2 is fixedly rotatably mounted and roll 3 is adjustably rotatably mounted. The axle 4 of roll 2 is affixed in the housing by the nut 5, and the roll itself is rotatably mounted by means of a ball bearing 14, such as illustrated in FIG. 2, mounted on the axle. The roll is covered with a rubber annulus disposed about a hub.

Roll 3 is adjustably mounted, and axle 6 thereof is mounted in a lever arm 7 which swivels about a journal 8. The lever arm 7 is situated on the exterior part of the housing 1 and the axle 6 penetrates a slotted hole 9 in the upper part of the housing. By pivoting the arm 7 in the direction to the roll 2, the pressure increases between the rolls. A threaded spindle 10 facilitates such an adjustment of the inter-roll pressure. Therefore the spindle 10 is threadedly mounted in a block 11 having an internal thread, and which block is fixed on the housing 1.

A flanged disc 12 having indicia disposed about one annular flange portion is attached to one end of spindle 10; such indicia allow a micrometer-regulation of the spindle axial movement. An indicator 13 is fixedly mounted in a block 11 for purposes of reading the indicia on disc 12.

Both rolls 2 and 3 are rotatably mounted by means of roller bearings 14 on their axles 4 and 6 respectively. In order to minimize the friction and the braking effect, the ball bearings are lubricated with oil. Both rolls have therefore a hub 15, which is filled partially with oil. In order to avoid oil escaping during rapid rotation of the rolls, the hubs are provided on the top with profilated rings 16. Yarn guides 17 are fixed in the side walls of the housing, and are made of long-wearing ceramic material. In the drawing, the yarn to be tensioned is identified as F, and is passed through the guides 17 and between the rolls 2 and 3 in the manner illustrated in FIG. 1. If necessary, the yarn can be guided in and out through guides 17'.

In FIGS. 1 and 2, both rolls 2 and 3 are covered with elastic rubber, so that a slight flattening is to be seen in applying a certain pressure onto the contacting surfaces of both rolls, as per FIG. 1. In FIG. 3 this contact surface is illustrated in section and on an enlarged scale. It will be noted from FIG. 3 that the yarn F is pressed into the surfaces of both rolls during processing.

FIG. 4 presents a roll modification in which only the roll 3 is covered with elastic rubber material, whereas roll 2' consists of metal. The yarn F is pressed entirely into the elastic covering.

In both FIGS. 1 and 2, at least at the contacting surface portion of the rolls an intensive contact of the yarn is guaranteed with the rolls, so that during the passage through the tensioning device, both rolls are driven by the yarn. Of course, it is an advantage if the yarn to be tensioned is, in addition, lying on a large circumferential segment of the roll (in FIGS. 1 and 2, 90% of the roll peripheries are engaged).

FIG. 5 presents a further modification of a yarn tensioning device, which differs from the embodiment of FIGS. 5 and 6 by the fact that the yarn to be tensioned is guided around the roll 30, the diameter of which differs from the diameters of both tension rolls 31, 32. In FIG. 5 the diameter of roll 30 is greater than that of roll 31. The diameter of the roll, where the yarn to tension is guided therearound, can also be smaller than those of the tension rolls. The variability of the diameter of such yarn-engaging rolls, enables the tensioning effect to be adjustable over a large range.

Varying conditions are employed with the described embodiments of tensioning devices; there are unwinding speeds up to 800 m/min. The rubber covering of the tension rolls becomes heated, due to the process of fulling. Therefore it is necessary to choose as a roll covering a rubber or an artificial rubber mixture, the hardness of which must not change or change minimally with heat, as otherwise the resulting tension force would be accordingly altered.

In FIG. 6, the rolls 2', 3' are fastened in supporting rails 40, 41 arranged parallel to each other. The rolls each comprise a hub 42 in the form of a tube which is covered with a rubber elastic material. Each hub 42 is supported by the exterior ring of a roller bearing 14, the interior ring of which is braced with a spacer tube 45 on a threaded pin 46 forming the axle 4'. This threaded pin is inserted through the supporting rail 41 and nut 47 engages the distal pin extremity and urges the interior ring of the roller bearing together with the spacer tube against the side of supporting rail 41.

The axle 6' of the roll 3' is fixed on a rotatable and adjustable link 48, mounted on supporting rail 40. This rotatably adjustable link is adjustable around the rotary axle 48'; it is formed either as a screw head or with an interior hexagonal recess for reception of a hexagonal key. The rotatable adjustable link penetrates the wall of the supporting rail 40 and axis of rotation 6'' of the axle 6', is arranged eccentrically, as presented. By turning the rotatable adjustable link 48 the roll 3' can be adjusted from the illustrated position to the position marked in broken lines so that the inter-roll pressure can be adjusted sensitively. Correspondingly the yarn F is more or less charged so that it is tensioned accordingly during the passage and driving of both rolls.

FIG. 7 illustrates a tensioning device modification in which supporting rails 40, 41 on which roll pairs 49 and 50, each pair engaging one yarn, are arranged therebetween. Each of the rolls, as in FIG. 6, is mounted on a verticle disposed axle, whereby each roll of each pair is rotatably mounted in one of the supporting rails. The rolls 49', 50' are mounted on the supporting rail 41, and the rolls 49'', 50'' on the supporting rail 40. Both rolls 49'' and 50'', similarly to roll 3' in FIG. 6, are adjustable so that the inter-roll pressure of a roll pair can be adjusted as desired.

The supporting rail 40 is guided by means of guide tubes 40' at its ends on the guide pins 41' of the supporting rail 41. Furthermore, transverse arm 51 of the supporting rail 41 supports a rotatably adjustable link 52. This rotatably adjustable link engages with its threaded distal end 52' a nut 53 of the supporting rail 40, so that a displacement of the supporting rail 40 to the right or to the left during rotation of the adjustable link 52 results. With such movement of rail 40, the rolls 49'', 50'' are displaced to the right or to the left, so that the yarn is pressed between the rolls in accordance with the inter-roll pressures. A spring 54 disposed between the free end of the supporting rail 40 and a free end of the transverse arm 51 of the supporting rail 41, positively loads the rotating adjustable link 52 into spaced relation with the supporting rail, so that any play or movement due to the tolerances in the thread of link 52 and the supports for the rolls is eliminated.

FIG. 8 schematically illustrates a plurality of supporting rail pairs 55, of the type disclosed in FIG. 7 in which the movable rails 40 move relative to the stationary rails 41. The rails 40 and 41 have the movable and fixed rollers, respectively, rotatably mounted thereon as explained relative to FIG. 7, and a creel 56 with a large number of bobbin positions is also illustrated. On the bobbin positions, bobbins 57 are schematically shown with yarns F being unwound therefrom. In the yarn tensioning apparatus of FIG. 8, all the tensioning devices must be regulated simultaneously. Therefore a rotatably adjustable link 58 is provided, and an adjustable spindle rotatably driven in the frame of the creel by means of hand wheels 58'. By turning wheels 58', rotary motion is transmitted to adjustable spindles 60 via two bevel gears 59. Each adjustable spindle can transmit, in accordance with the turning thereof, each movement to a movable roll supporting rail 40 of a supporting rail pair 55, there being a worm gear 61 or the like arranged between the supporting rail and the adjustable spindle. Thus movement of a rail 40 simultaneously adjusts the inter-roll pressure of the series of rolls mounted in the rail pair 55 of which the moved rail comprises an element.

In FIG. 6 the roll 2' of the roll pair 2', 3' supports an air current producer, or impeller 62. This impeller is mounted with its hub 62' in the hub 42 of the roll 2' and the radially arranged blades produce an air current in the field of the tensioning position. Such current prevents the accumulation of dust and fibre fly. It is known in the art to use for one or more winding positions on a winding machine a common exhaust system, which keeps the winding positions free of dust and fibre fly. This common blowing device is, however, not applicable for use with a plurality of positions when employing creels with a large number of yarn tensioning positions, since it is not possible to maintain a plurality of tensioning positions dust free by a common fan device at low cost. The provided impeller is therefore a producer of air currents, which meets completely the required cleaning requirements without large construction costs.

Furthermore, the air current can contribute to the cooling of the outer rubber elastic material of both rolls, since they are heated due to the fulling process. It is, however, possible to use materials which do not dispose of the otherwise required thermal resistance without an impeller.

The yarn tensioning devices described above are not limited to use with textile yarns, but are also adaptable for use in the formation and tensioning of, for example, metallic wires, belts, etc., running in a longitudinal direction.

We claim:

1. In a yarn tensioning device the combination comprising a plurality of parallel roll pairs; said rolls having substantially vertical axes of rotation; the rolls of each pair being adapted to rotatably contact at a peripheral area of mutual engagement; at least one roll of each of said pairs having an outer periphery of elastic material; a plurality of aligned movable rails, each of said movable rails having a plurality of rolls mounted thereon, each roll comprising one roll of a roll pair; the rolls mounted on each movable rail being movable toward the other rolls of the roll pairs of which the rail mounted rolls form a part; said other rolls of the roll pairs being mounted on a stationary support; a common drive means for said plurality of aligned rails for simultaneously actuating said movable rails and the rolls mounted thereon toward the other rolls of said roll pairs with a force adequate to cause said rolls of said roll pairs to engage in surface-to-surface contact of such magnitude as to effect a desired resistance in the rotatability of said rolls; said elastic material disposed on said rolls having said elastic material on the peripheries thereof deforming from an arcuate configuration formed along the radius of said one rolls when entering said area of mutual engagement and reassuming said arcuate configuration when leaving said area of mutual engagement; axles having low friction bearings mounted thereon; said rolls being mounted on said bearings; the resistance to roll rotation being effected substantially completely by the elastic deformation resulting from the inter-roll forces effected by said common drive means; the inter-roll pressure being adequate to retain a yarn between the vertically mounted rolls without dropping, and a discrete yarn to be tensioned, positioned between each of said roll pairs in said roll area of mutual engagement in the normal course of device operation.

2. The device of claim 1 in which an air impeller is mounted on one of said rolls of each of said roll pairs to rotate therewith the normal course of device operation.

3. A yarn tensioning device comprising a plurality of aligned pairs of mutually engageable, rotatable rolls arranged in a series; each of said rolls of each of said pairs of said series being rotatably mounted about a vertically disposed axle; at least one roll of each of said pairs having an outer periphery of elastic material; one roll of each of said pairs being movable toward the other roll of said each pair with a predetermined force at the area of mutual rotatable engagement whereby the rolls of each pair engage in a surface-to-surface contact of such magnitude as to effect a desired resistance in the rotatability of the rolls; said elastic material deforming from a circular configuration formed along the radius of each of the rolls having the outer peripheries of elastic material, when entering said area of mutual engagement, and substantially reassuming said circular configuration when leaving said area of mutual engagement; the inter-roll pressure being adapted to retain a yarn member between the vertically mounted rolls without dropping; a discrete yarn to be tensioned being received between each roll pair in said roll area of mutual engagement in the normal course of device operation, and means for simultaneously moving the movable roll of each of said pair of rolls in said series relative to the other said roll of each of said pair of rolls in said series whereby the inter-roll pressure of said plurality of aligned pairs of rotatable rolls is simultaneously regulated.

4. A yarn tensioning device in which a plurality of series of aligned pairs of mutually engageable rotatable rolls as recited in claim 3 are arranged in alignment and a common drive is connected to each of the means for simultaneously moving the movable roll of each of said pairs of rolls of each series, whereby said common drive simultaneously regulates the inter-roll pressure of each roll pair of all of said aligned series.

* * * * *